United States Patent [19]

Zimmerman

[11] 4,300,604

[45] Nov. 17, 1981

[54] SYSTEM TO PRODUCE WOOD PRODUCTS FROM PEELER CORE LOGS

[76] Inventor: Edwin H. Zimmerman, R.D. #1, New Holland, Pa. 17557

[21] Appl. No.: 148,765

[22] Filed: May 12, 1980

[51] Int. Cl.[3] ..... B27C 9/04

[52] U.S. Cl. ..... 144/41; 83/51; 144/39; 144/323

[58] Field of Search ..... 144/3 R, 312, 37, 39, 144/1 R, 249 R, 249 A, 326 R, 323; 83/404, 51

[56] References Cited

U.S. PATENT DOCUMENTS

| | | | |
|---|---|---|---|
| 932,373 | 8/1909 | Burns | 144/39 |
| 3,304,971 | 2/1967 | Pease | 144/312 |
| 3,452,793 | 7/1969 | Wexell | 144/312 |
| 4,009,741 | 3/1977 | Zimmerman | 144/41 |

FOREIGN PATENT DOCUMENTS

| | | | |
|---|---|---|---|
| 937376 | 1/1956 | Fed. Rep. of Germany | 144/39 |
| 616123 | 7/1978 | U.S.S.R. | 144/39 |

*Primary Examiner*—W. D. Bray

*Attorney, Agent, or Firm*—C. Hercus Just

[57] ABSTRACT

A saw and chipping device to convert veneer peeler logs into pieces of lumber of dimensions to produce maximum useful products and minimum waste and comprising a pair of similar sets of saws and intervening chippers on a pair of parallel power driven arbors respectively above and below a path of travel for said logs and one arbor trailing the other a predetermined distance, said saws respectively sawing said logs in common planes from opposite sides to a depth slightly greater than half the diameter thereof to form complete cuts to form adjacent boards varying in diameter in accordance with the sections of the logs in which they occur, feed rollers power driven in directions to feed logs to said sets of saws and chippers, and auxiliary guide rollers downstream from said sets of saws and chippers provided with stepped circular surfaces above and below said path of travel, the diameters of said stepped surfaces increasing in diameter from the center toward the opposite ends of said rollers in accordance with the width of the boards passing between similar opposite stepped surfaces of said rollers and thereby guide the sawed boards and support them as they are moved past said saws and chippers.

5 Claims, 6 Drawing Figures

10
12
14
16
18
22
26
32
34
36
38
40
42
44
46
48
50
52
54
56
58
60
62
64
66
68
70
72
74
5
5

SYSTEM TO PRODUCE WOOD PRODUCTS FROM PEELER CORE LOGS

BACKGROUND OF THE INVENTION

This invention is concerned with formation of useful wood products, including boards and other types of lumber from relatively small diameter logs or the like, and more particularly, to producing such products from peeler core logs which are the center portions of logs from which veneer products in sheet form are cut or sliced from the perimeters of logs until the central core thereof is too small for further production of veneer sheets. Logs from which veneer sheets or strips are shaved or otherwise formed usually are of uniform length, such as, for example, eight feet six inches. Depending upon the thickness of the veneer sheets produced from such logs, and also considering the value of the types of wood which are formed into veneer sheets, the peeler cores which remain at the end of the veneer production operation are anywhere from four and one-half inches to eight inches in diameter but these dimensions are intended to be exemplary rather than specific. Various uses have been made of such peeler cores without particularly giving consideration to the most efficient or economical use of the same to form useful products.

A similar problem also has been present in the lumbering industry, for example, relative to the formation of useful wood products from small diameter logs. For example, logs five or six inches or slightly greater in diameter are useful in the lumbering industry because the trees are not of great age and there is considerable abundance of such size. Examples of solutions to the use of small logs of the size referred to are formed in prior U.S. Pat. Nos. 3,304,971 to Pease, dated Feb. 21, 1967 and 3,452,793 to Wexell, dated July 1, 1969. Several problems are present in the use of small diameter logs in accordance with the aforementioned patents, however, as compared with forming useful wood products from peeler core logs. One such problem is that frequently the small diameter natural logs are crooked or non-cylindrical. Another is that, especially in accordance with the aforementioned patents, several passes of the logs through sawing apparatus are necessary to form desirable products such as by passing the logs through the sawing apparatus more than once, as distinguished from a single passage, in order to form a useful product as readily can be seen from the illustrations in the aforementioned patents.

In contrast to the foregoing, the present invention offers considerable improvement and greater efficiency in the production of useful wood products from peeler core logs, details of which are set forth in the following specification.

SUMMARY OF THE INVENTION

It is among the primary objects of the present invention to provide a system which handles peeler core logs and produces useful wood products, such as boards and similar products therefrom, preferably during a single passage of the logs through the device comprising the preferred embodiments of the present invention, the finished products being formed preferably by an assembly of saws, and particularly a plurality of sets of said saws respectively arranged to cut slightly more than half way through the peeler core logs within common planes to form a complete cut for each board or similar product from the core log and the edges are formed in final fashion by employing chipping cutters or chippers respectively between adjacent saw blades in the aforementioned sets thereof, the diameters of said chippers being graduated in accordance with the sections or portions of the logs engaged thereby incident to the adjacent pieces being separated by the saws while the opposite edges are shaped by the chippers, whereby the products produced are of varying widths as can be appreciated from the fact that the widest pieces will be formed from the central portion of the logs and the narrowest pieces will be formed from the outermost portions thereof and the thickness of said pieces may either be uniform or vary in accordance with desired spacings btween the saw blades which are occupied by the chippers.

Another object of the invention is to feed the peeler core logs to the sawing and chipping apparatus by power means which insure the longitudinal feeding of the logs through the sets of saws and chippers respectively above and below said logs and, following the formation of the products by said set of saws and chippers, the emerging ends of the products are engaged by appropriate guide and support rolls which generally are conformed to the cylindrical boundary of the assembly of products formed simultaneously by one passage through the sets of saws and chippers, said guiding and support rolls being power driven and respectively engaging the upper and lower edges of the formed products so as to maintain them in assembled relationship and preferably in vertical planes, thereby rendering the products capable of readily being handled either manually or by appropriate subsequent mechanisms to carry the same from the sawing and chipping mechanism.

A still further object of the invention ancillary to the immediate foregoing object is to form said guide and support rolls in the nature of circular stepped surfaces of varying diameters such that the upper and lower rolls define therebetween a generally cylindrical space corresponding approximately to the diameter of the assembled wood products which are in side-by-side relationship when passing through said guide and support rolls, said rolls respectively preferably engaging the upper and lower edges of the assembled products.

Still another object of the invention ancillary to the preceding object is to form said circular stepped surfaces of said guide and support rolls either from integral castings or machined metallic pieces or from, preferably, sets of discs of desired thickness and graduated diameters which are assembled upon arbors and clamped thereto in order that the same may be positively driven by power means connected to said arbors.

Details of the foregoing objects and of the invention, as well as other objects thereof, are set forth in the following specification and illustrated in the accompanying drawings comprising a part thereof.

DETAILED DESCRIPTION OF THE PREFERRED EMBODIMENTS

To a limited extent, the present invention is a carrying forward of the saw arrangement described and claimed in applicant's prior U.S. Pat. No. 4,009,741, dated Mar. 1, 1977. In said patent, it will be seen that the sets of saws are of similar diameter and are respectively disposed above and below the cant, which is to be formed into adjacent boards by a single pass through the sets of saws, said saws respectively being in common vertical planes and each saw cutting into the cant slightly more than half the vertical dimension thereof, thereby forming a single cut, each formed by a pair of saws, this being possible due to the fact that one set of saws is positioned a limited distance longitudinally from the other set, whereby the sets are not in vertical alignment with each other, but the arbors upon which the saws are mounted are parallel to each other. By such arrangement, there is a substantial saving of power and saws of much smaller diameter may be employed than when using a single saw or a single set of saws to make the complete cut through a cant or similar object.

Figure 2:
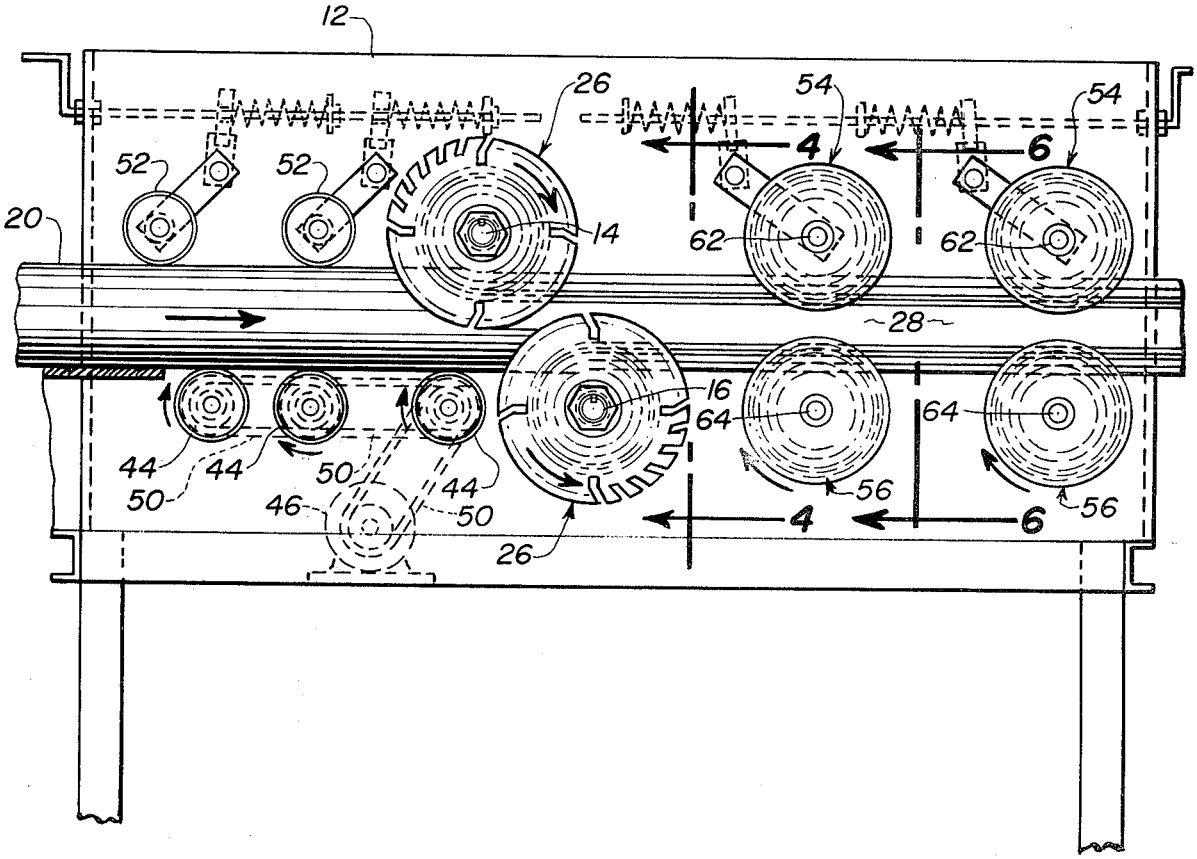
FIG. 2 is a side elevation of an exemplary system for forming useful wood products from peeler core logs in accordance with the principles of the present invention.
Figure 3:
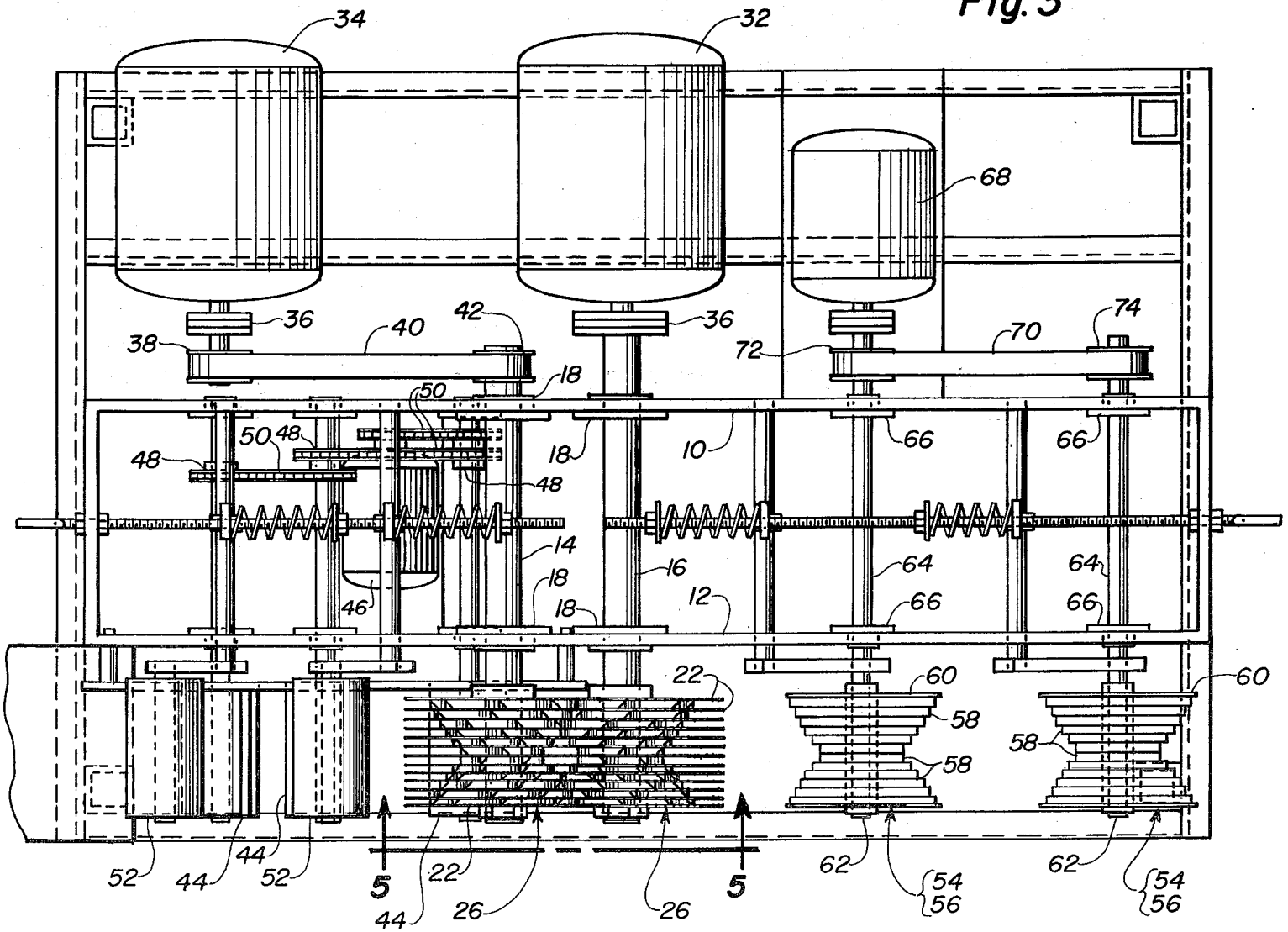
FIG. 3 is a top plan view of the system shown in FIG. 2.
Figure 5:
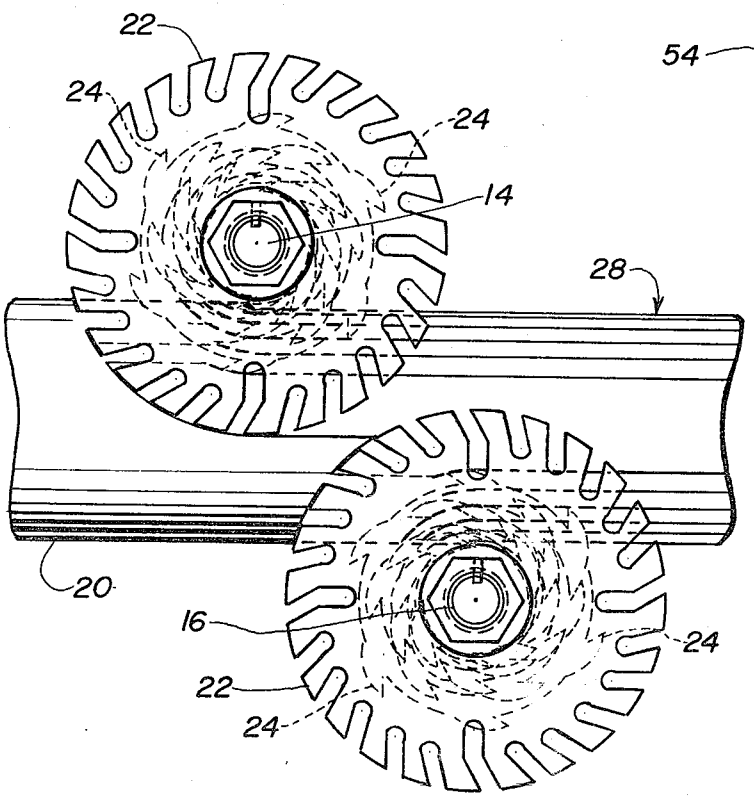
FIG. 5 is a fragmentary enlarged view of the sets of saws and chippers of the system as shown in FIG. 3 on the line 5—5 thereof to illustrate the various diameters of the chippers.

Referring to FIG. 2, which is a substantially diagrammatic side elevation of a system employing the principles of the present invention, but more particularly to FIG. 3, which is a plan view of the system shown in FIG. 2, it will be seen that the present invention comprises a pair of side frame plates 10 and 12 which are supported by appropriate means, not shown, but are, for example, similar to those shown in applicant's prior U.S. Pat. No. 4,009,741. A pair of saw arbors 14 and 16 extend through the side plates 10 and 12 and are supported by appropriate bearings 18 on said opposite frame plates. As shown in FIGS. 2 and 5, the arbor 16 is above the peeler core log 20, while the arbor 14 is below the same.

Figure 4:
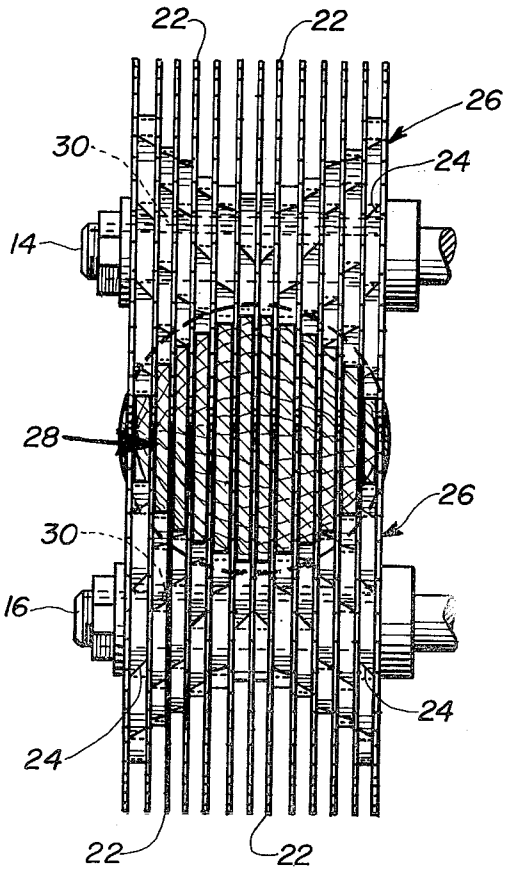
FIG. 4 is a vertical end view of the sets of saws and chippers shown in FIGS. 2 and 3 generally as seen on the line 4—4 of FIG. 2 and being on a larger scale than employed in said figure.

Said arbors respectively support and have keyed thereto sets of circular saws 22, which, as shown in FIG. 4 in particular, preferably are of the same diameter. Said saws are spaced from each other to accommodate sets of chipping cutters or chippers 24 which are of graduated diameter, as best shown in FIG. 4, the smaller ones being in the center and the others progressively increasing in diameter toward the outer ends of said sets of saws and chippers 26.

Figure 1:
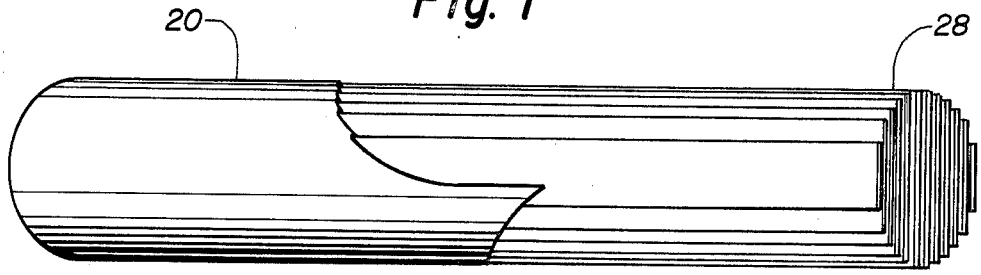
FIG. 1 is a fragmentary perspective view of one end of a peeler core log partially transformed into useful boards or lumber products in accordance with the present invention.

As can be seen best from FIG. 4, the upper and lower sets of saws and chippers 26 define therebetween a generally circular space, the outline of which is smaller than the diameter of the peeler core log 20 as can be appreciated from the perspective fragmentary view of FIG. 1, wherein it will be seen that the left-hand end of the log 20 is of larger diameter than the side-by-side arrangement of exemplary boards 28, shown at the right-hand end of FIG. 1, due to the fact that the opposite edges of the board have been formed so as to be perpendicular to the planes of the boards under circumstances when the chippers 24, for example, have teeth which are pendicular at the ends to the planes of the chippers. However, it is to be understood that if desired, these opposite edges of the boards may be shaped otherwise, such as to have tongue and groove, ship lap edges, or otherwise, as, for example, explained in greater detail in applicant's prior U.S. Pat. No. 4,009,741. It can be appreciated that the removal of the portions of the logs at the opposite edges of the exemplary boards 28 will decrease the overall outer configuration of the assembled boards and, as stated above, the diameter of such assembly will be less than that of the original log 20.

One of the advantages of the present invention which is adapted to be employed with peeler core logs is that said logs are always of uniform diameter, in addition to usually being of uniform length, whereby for a given supply of peeler core logs of the same diameter, for example, sets of saws and chippers 26 of desired diameters can be selected and mounted appropriately upon the upper and lower arbors 14 and 16 and preferably the same are keyed thereto by exemplary keys 30. Accordingly, the invention can employ, accurately arranged, such sets of saws and chippers 26 in view of the uniform size of the material being worked upon, as distinguished from conventional logs, which, in general, vary from each other, both in diameter and straightness.

Referring to FIG. 3, exemplary power means are illustrated to drive the arbors 14 and 16 respectively in opposite rotary directions, as indicated by the exemplary arrows on the chipper and saw assemblies, illustrated in FIG. 2, said power means preferably comprise a pair of electric motors 32 and 34. Preferably, conventional clutches 36 are connected to the shafts of said motors and, if desired, the motor 32 may be directly connected to the arbor 14, whereas the motor 34 preferably has a pulley 38 mounted thereon for purposes of driving a belt 40 which also extends around another pulley 42 which is fixed to the arbor 16. In addition, the peeler core logs 20 are fed toward the sets of saws and chippers 26, such as indicated by exemplary arrows in the various figures, by means of a plurality of positively driven bottom feed rolls 44 which are mounted on suitable shafts extending between the side frame plates 10 and 12, for example, and rotatable in suitable bearings therein, not shown. An appropriate electric motor 46 supplies the power for said feed rolls and is connected thereto in any suitable manner, such as by the drive shaft of the motor being connected directly to the shaft of the outermost roll 44, as shown at the left-hand end of FIG. 3 and appropriate drive gears and chains are mounted upon the various shafts for the bottom feed rolls 44 and extend therebetween as shown in exemplary manner in FIG. 3, such arrangement being similar to that employed in applicant's prior U.S. Pat. No. 4,009,741.

In order to maintain the peeler core logs in engagement with the drive rolls 44, upper pressure rolls 52 engage the upper surface of such core logs, as best shown in FIG. 2, in which a pair is illustrated. Spring pressure is exerted upon said pressure rolls, such as shown in exemplary manner in FIG. 2, the details of said means being similar to those also shown in applicant's prior U.S. Pat. No. 4,009,741, attention to which is directed for such details, or by other suitable means.

Figure 6:
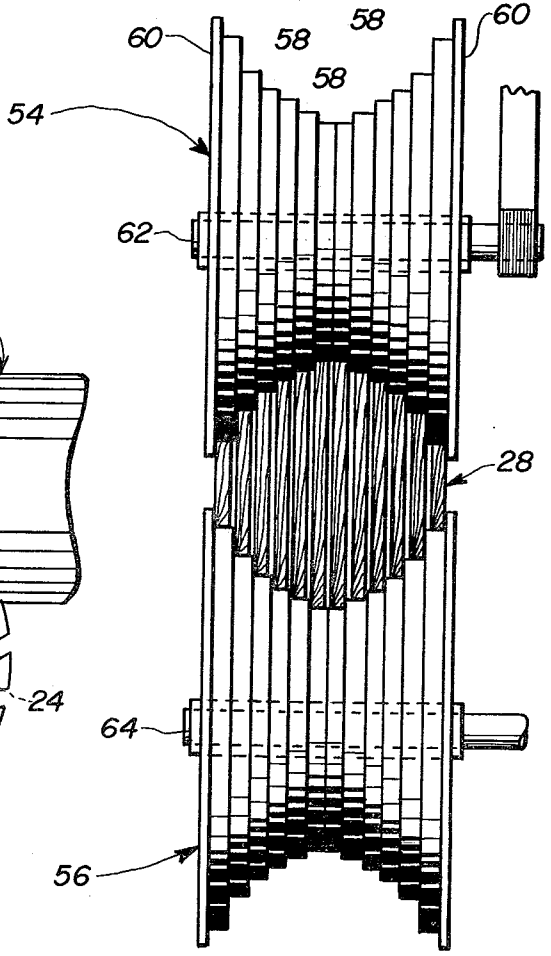
FIG. 6 is a vertical end view similar to FIG. 4, but showing the stepped type support and guide rolls as generally seen on the line 6—6 of FIG. 2, but illustrated on a larger scale than in said figure.

One of the more important features of the present invention comprises means by which the wood products formed by the sets of saws and chippers 26 are supported and guided incident to the same being formed by said sets 26. For example, under certain circumstances, said boards may be relatively thin, such as of the order of possibly as little as one-half inch, and when this size of board is formed from the log of five or six inches in diameter, for example, the exemplary boards 28 are much more flexible than a group of a limited number of boards one inch or more in thickness or a limited group of pieces of two-by-fours or other sizes of stud-type items. Accordingly, the present invention includes preferably a plurality of pairs or sets of guide rollers 54 and 56, respectively mounted above and below each other, as shown in FIGS. 2 and 6. The required number of pairs will be determined by the length of the logs and the corresponding wood products formed therefrom and particularly the rigidity or flexibility of said products and the amount of support required thereby to maintain them in orderly fashion for delivery to suitable receiving apparatus, not shown. The shape and construction of said guide rollers is clearly shown in FIGS. 3 and 6, wherein the contour thereof is complementary to the opposite edges of the groups or sets of exemplary boards 28 formed by the sets of saws and chippers 26. If desired, said rolls may be formed of a solid nature and suitably cast or machined to preferably provide the same with a circular stepped arrangement, as shown in FIGS. 3 and 6, but particularly for purposes of versatility, it is preferred that said guide rollers 54 and 56 be formed of a series of discs of varying diameters which, when assembled, are complementary to the assembled opposite edges of the product boards 28. Further, said discs may all be of the same thickness or of different thicknesses, depending upon the thickness of the sawed products which are passed to the guide rollers, which thicknesses may either be uniform or different, in accordance with the width of the spaces between the saws of the sets 26 thereof and the corresponding widths of the chippers therebetween, due to the fact, as mentioned above, that different thicknesses of the products may be selected in accordance with the type of product to be formed from any given set of peeler core logs.

The exemplary discs 58 of the pressure rollers 54 and 56 as shown in FIG. 6, as well as those in FIG. 3, are illustrated as being of uniform thickness and the diameters of the sets of said discs shown therein, correspond to the width of the boards 28 which are fed to said guide rollers from the sets of saws and chippers 26. Due to the fact that the saws have formed cuts in the logs, the boards 28 produced therefrom, will be spaced from each other in accordance with the thickness of the saw blades, whereby the width of the discs 58 preferably correspond to the thickness of the board or other wood products engaged by the perimeter of the disc, plus the thickness of one saw blade. Further, it is preferred that the opposite ends of the sets of discs 58, which form the composite guide rollers 54 and 56, each have an outermost disc 60 of larger diameter than the next adjacent disc, and all of said discs are clamped upon suitable supporting arbors 62 and 64 which extend through suitable bearings 66 mounted upon the side frame plates 10 and 12, for example.

Both the upper and lower guide rollers 54 and 56 are positively driven by suitable means, such as electric motor 68, which, for example, may be directly connected to the upper or lower arbor 62 or 64 of one set of said guide rollers and, by appropriate means, not shown, extending between the aforementioned upper and lower set of arbors, they are driven in opposite directions as shown by the exemplary arrows in FIG. 2. Further, a single motor 68 may be employed to drive a plurality of sets of said guide rollers 54 and 56, and by means of a belt 70, for example, which extends between pulleys 72 and 74, respectively, connected to the upper or lower arbors 62 and 64 of successive sets, all of the sets of guide rollers 54 and 56 will be driven in take-away direction to deliver the sawed relatively finished wood products to any desired type of additional handling or processing equipment or apparatus.

From the foregoing, it will be seen that the present invention provides mechanism for utilizing to maximum advantage veneer peeler core logs which are converted into useful wood products in the nature of boards of desired thickness, stud items, or the like, it being understood that the selection of the width of the products, for example, especially the thickness thereof, are selected for the best utilization of the maximum amount of log material, and thereby minimize waste in the form of chips and sawdust. Due to the preferred arrangement of selectability of the diameters and widths of chippers and the corresponding selectability of the desired diameters and widths or thicknesses of the discs 58 of the guide rollers 54 and 56, the system comprising the present invention lends itself to substantial utility to produce such maximizing of wood products with minimum waste, particularly from various diameters of veneer peeler core logs which, however, lend themselves to be processed by the system of the invention due particularly to the straightness and uniform diameter throughout the length of such logs, as distinguished from irregular shapes, diameters and crookedness of conventional logs.

The foregoing description illustrates preferred embodiments of the invention. However, concepts employed may, based upon such description, be employed in other embodiments without departing from the scope of the invention. Accordingly, the following claims are intended to protect the invention broadly, as well as in the specific forms shown herein.

I claim:

1. A saw and chipping device to convert veneer peeler core logs into useful boards of a dimension to produce maximum useful products and minimum waste comprising in combination, a pair of parallel arbors and power means to rotate the same in opposite directions, said arbors respectively being above and below a longitudinal path along which said logs travel, similar sets of alternate saws and chippers keyed respectively to said arbors, the diameters of said saws being selected to cut slightly more than half the diameter of said logs and one set trailing the other a predetermined distance and similar saws of said sets being in common planes perpendicular to said arbors, whereby said sets of saws cooperate to make complete cuts through said logs, and said sets of saws having said chippers therebetween which progressively increase in diameter respectively from the mid portion of each set of blades toward the opposite ends of said sets and the tips of said chippers being shaped to produce desired finished opposite edges on the assembly of boards sawed simultaneously by said saws of maximum varying widths according to the section of the logs sawed by said saws and the shape of said boards being selected by the number of saws and diameter of chippers to maximize useful boards and minimize edge waste, feed rollers upstream from said sets of saws and chippers to guide peeler logs to and through said sets of saws and chippers, and at least one pair of auxiliary guide rollers downstream from said saws and chippers and comparable in width to the same and respectively above and below the sawed boards and provided with circular surfaces increasing in diameter from the center toward the opposite ends and substantially complementary to the opposite edges of the sawed board assemblies to support and guide the same in discharging direction from said saws and chippers.

2. The device according to claim 1 in which the outermost chippers are shaped to form smooth flat surfaces on the outermost boards of the assembly thereof formed by said device.

3. The device according to claim 1 in which said auxiliary guide rollers have similar sets of circular stepped surfaces respectively complementary to the edges of the boards produced by said saws and chippers and progressively increasing in diameter from the center toward the outer ends of said rollers.

4. The device according to claim 3 in which said circular stepped surfaces comprise sets of separable discs of desired varying diameters, and including supporting arbors extending through complementary central holes in said discs and means on said arbors clamping said discs to said arbors and each other.

5. The device according to claim 3 further including circular flanges on opposite ends of said auxiliary guide rollers extending beyond the stepped surfaces and engageable respectively with the outer surfaces of the outermost boards of said assembly thereof.

* * * * *